US005360136A

United States Patent [19]

Fyson et al.

[11] Patent Number: 5,360,136

[45] Date of Patent: Nov. 1, 1994

[54] DISPENSING APPARATUS

[75] Inventors: John R. Fyson; Edward C. Glover, both of London, United Kingdom

[73] Assignee: Eastman Kodak Company, Rochester, N.Y.

[21] Appl. No.: 50,486

[22] PCT Filed: Sep. 15, 1992

[86] PCT No.: PCT/EP92/02114

§ 371 Date: May 10, 1993

§ 102(e) Date: May 10, 1993

[87] PCT Pub. No.: WO93/06012

PCT Pub. Date: Apr. 1, 1993

[30] Foreign Application Priority Data

Sep. 24, 1991 [GB] United Kingdom ..... 9120349

[51] Int. Cl.[5] ..... G07F 11/00

[52] U.S. Cl. ..... 221/85; 221/216; 414/411

[58] Field of Search ..... 221/25, 26, 218, 217, 221/216, 253, 214, 216, 69, 71, 72, 73, 74, 76, 79, 80, 82, 84, 85, 89, 311; 414/411, 412, 418, 403

[56] References Cited

U.S. PATENT DOCUMENTS

| | | | |
|---|---|---|---|
| 2,889,958 | 6/1959 | Ekenstam et al. | 221/25 |
| 2,923,392 | 2/1960 | Gabrielsen | 221/85 |
| 3,027,047 | 3/1962 | Johnson | 221/30 |
| 3,129,814 | 4/1964 | Cheh et al. | 206/56 |
| 3,169,895 | 2/1965 | Sohn | 156/361 |
| 3,260,404 | 7/1966 | Critchell | 221/13 |
| 3,340,789 | 9/1967 | Simjian | 99/352 |
| 3,340,790 | 9/1967 | Simjian | 99/352 |
| 3,428,733 | 12/1969 | Groves | 221/25 |
| 4,046,613 | 9/1977 | Kucheck et al. | 221/73 |
| 4,094,129 | 6/1978 | List | 221/253 |
| 4,607,761 | 8/1986 | Wright et al | 221/73 |
| 4,909,414 | 3/1990 | Heath | 221/25 |

FOREIGN PATENT DOCUMENTS

| | | | |
|---|---|---|---|
| 633635 | 12/1963 | Belgium | 221/25 |
| 322360 | 3/1919 | Germany | 221/216 |
| WO82/00456 | 2/1982 | WIPO | B67B 7/00 |
| WO91/07332 | 5/1991 | WIPO | B65D 75/34 |

*Primary Examiner*—Kenneth W. Noland
*Attorney, Agent, or Firm*—Frank Pincelli

[57] ABSTRACT

Dispensing apparatus are well known for dispensing material from a package. Described herein is apparatus for dispensing predetermined amounts of material (10, 10') stored in vessels (12) carried by a continuous web (14). The apparatus comprises a roller (18) over which the web (14) moves. A stop bar (20) is positioned above the roller (20) so that as the web (14) passes over the roller (18), the vessels (12) engage the bar (20) and are separated from the web (14) thereby releasing the material (10').

5 Claims, 1 Drawing Sheet

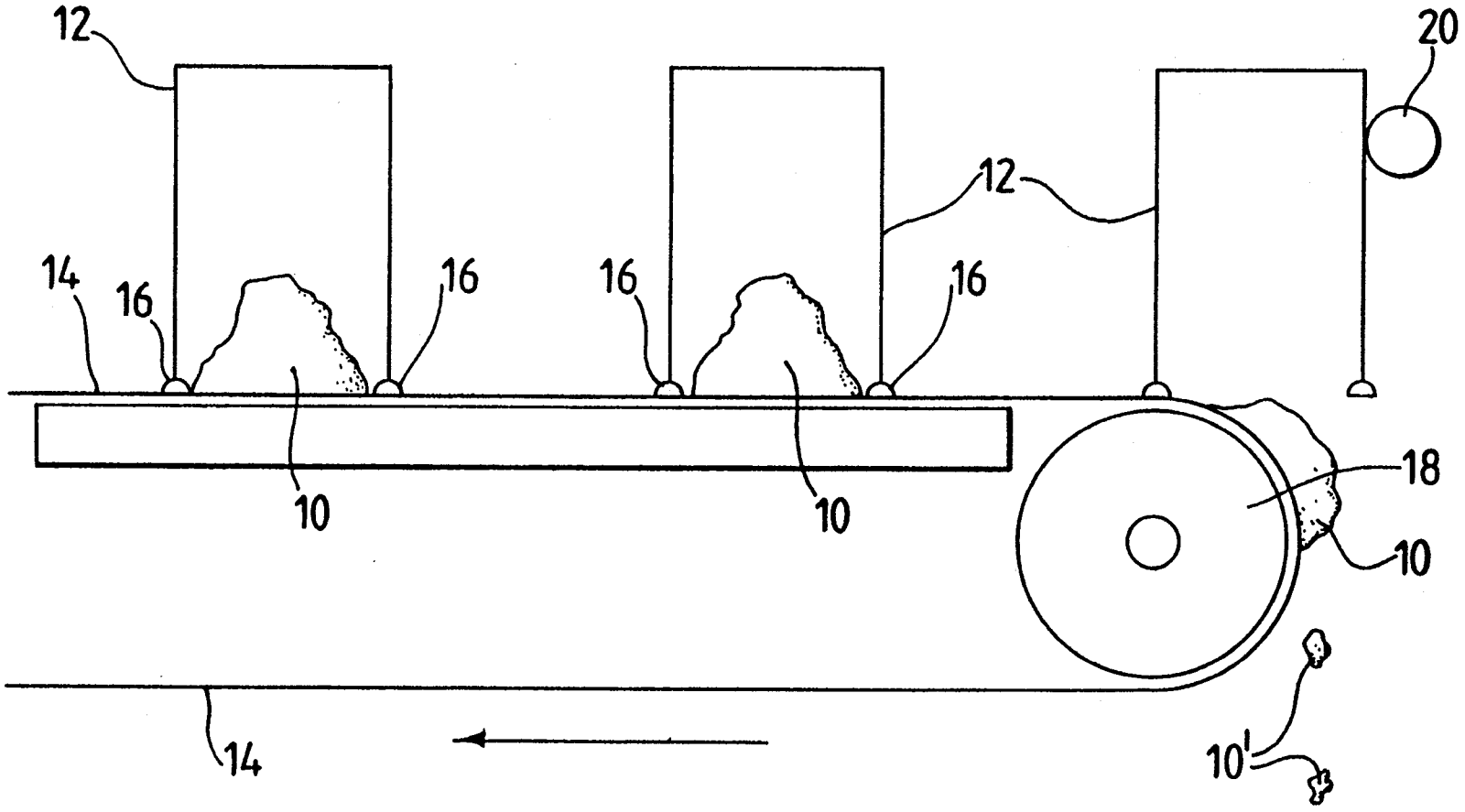
20
12
16
10
16
16
10
16
12
14
18
10
10'
14

DISPENSING APPARATUS

This invention relates to dispensing apparatus and is more particularly, although not exclusively related to dispensing apparatus for use in dispensing replenishment materials for photographic processing equipment.

It is well-known to package material in 'blister' packs which comprise a 'blister' portion attached to a frangible backing portion, the material being retained between the 'blister' portion and the backing portion until pressure is applied to the 'blister' portion to force the material out through the backing portion. One well-known use of such packs is for the storage of medicaments in tablet form.

U.S. Pat. No. 2,889,958 discloses a dispensing device for dispensing articles in unit form. The articles are stored pockets formed in a pliable strip. The pockets are formed by two strip portions which are joined together to form the pliable strip. The strip is folded in accordion fashion and stored in a box arrangement. The articles are dispensed by pulling the strip up through an opening in the box arrangement and under a guide plate which causes the two portions of the strip making up the pocket to open and release the article.

U.S. Pat. No. 3,340,789 discloses dispensing apparatus for dispensing food stored in a package in the form of a long flexible band. In this apparatus, the package containing the food is passed from a refrigerator in a continuous strip, where the food is stored prior to use, to a conditioning station where the food is conditioned before passing on to a dispensing station. At the dispensing station, the food is removed from the packaging using a knife edge which allows the food to fall into a receptacle positioned below the knife edge. The empty packaging, still in strip form, is then passed through a roller arrangement into a collection container.

U.S. Pat. No. 3,340,790 discloses a similar arrangement to U.S. Pat. No. 3,340,790. The packaging in this case is not in strip form but in the form of individual sachets or packets. As in U.S. Pat. No. 3,340,789, each sachet or packet is opened by a knife edge at a food removal station after passing from the refrigerator to a conditioning station.

U.S. Pat. No. 3,260,404 describes a plastic web comprising a plurality of pouches in which articles are stored prior to dispensing. Each pouch has a closed side and a partly open side through which the article can be dispensed. In order to effect dispensing of the articles, the web is directed to an ejecting station where an air jet is applied to the closed side of each pouch to force the article stored therein through the open side.

U.S. Pat. No. 3,482,733 describes a strip package comprising a carrier strip and a plurality of cover strips each containing material to be stored prior to dispensing. Each cover strip is spaced from its adjacent cover strip by an incision through which tear-off blade separates the cover strip from the carrier strip to dispense the material stored therein. The carrier strip further includes feed holes to allow for accurate delivery of the package for dispensing.

However, none of the packaging described above allows for the components making up the packaging to be re-used.

According to one aspect of the present invention, there is provided dispensing apparatus for dispensing material stored in a vessel attached to a continuous web, the apparatus comprising:

drive means for driving the web through the apparatus, and removal means for removing the material from the vessel, characterized in that the removal means includes an obstruction for engaging each vessel and detaching it from the web to release the material stored therein.

For a better understanding of the present invention, reference will now be made, by way of example only, to the accompanying drawing, the single FIGURE of which illustrates apparatus for dispensing materials stored in packaging in accordance with the present invention.

BRIEF DESCRIPTION OF THE DRAWING

The FIGURE is a schmetic representation of a dispensing apparatus made according to the present invention.

DETAILED DESCRIPTION OF THE INVENTION

In accordance with the present invention, material 10 for treating photographic effluent or for replenishing photographic processes is stored in a plurality of rigid storage vessels 12 which are carried on a flexible web 14. The vessels 12 are attached to the web 14 by sealant or glue, indicated by 16. The material 10 is stored in the vessels 12 attached to the web 14 until it is required for use.

Each vessel 12 contains a pre-weighed amount of material 10 and which can be added to the process according to requirements. The material 10 may be either in solid or liquid form as desired or even in the form of a mixture or slurry. Furthermore, the material 10 can be put into the vessels 12 at a site remote from the processing apparatus. This means that precision weighing of solids or dispensing of liquids can be carried out away from the processing site in an environment more suitable to that particular function. This also reduces the cost of machinery near the process and removes the possibility of corrosion of the weighing or measuring apparatus.

The material 10 required for a process is weighed into vessels 12 which are suitably shaped and sized. These vessels 12, once full with the required amount of material 10, are glued to the web 14 using a suitable glue, preferably one which is not 'sticky' at the temperature of the environment in which the material 10 is to be dispensed. The vessels 12 may be glued to the web using automated machinery if suitable.

The vessels 12 and web 14 are made of suitably inert materials, that is, material which do not react with the material 10 to be stored therein.

The glue must not be so adhering as to prevent the web 14 being stripped away from the vessels 12 in the dispensing apparatus. One form of glue found to be suitable is the glue which is used in 'hot glue' guns.

In the FIGURE, a simple arrangement for dispensing the material 10 is shown. The apparatus comprises a drive mechanism (not shown in detail) for moving the web 14 and the attached vessels 12 through it. As shown, the web 14 is arranged to pass over at least one roller 18 which provides a means of changing the direction of movement of the web 14. The roller 18 is driven by conventional means (not shown) in this case and causes the web 14 to pass under a stop bar 20. As the rigid vessels 12 protrude above the web 14 and also above the bar 20, when they hit the stop bar 20, they become detached from the web 14. The material 10 originally stored in the rigid vessel 12 is then free to fall away, indicated as 10'. This material 10' can then be used to replenish any photographic process.

Although the dispensing of the material 10 is described as being effected by stripping the vessels 12 away from the web 14 using a stop bar 20, any other obstruction can be provided which prevents further movement of the vessels 12 with the web 14 to which they are originally attached.

Furthermore, the roller 18 can be replaced by any other means which allows the web 14 to change its direction of movement, for example, a sharp edge. In such a case, the drive for the web 14 is located elsewhere in the apparatus. For example, the drive may be a pair of pinch rollers which pull the web through the apparatus and then direct the used web to a waste bin or other collection arrangement. Alternatively, one of the pinch rollers may serve as a base on to which the web is re-wound after the material and vessel have been removed.

In the arrangement described above, only one web 14 is shown carrying vessels 12 and passing over roller 18. Each web may be such that the material stored in the vessels attached to it is the same. Several such webs could be arranged to pass over the same roller to dispense several different materials to the same stage of the processing apparatus—each web carrying one particular material only.

Alternatively, the material may be different in each vessel but arranged on the web in a predetermined sequence, for example, A, B, C, A, B, C, A, . . . , etc (where A, B and C are three different materials).

Additionally, several webs each carrying a different material could be arranged so that several different materials can be dispensed to different stages of the processing apparatus at the same time. Furthermore, each web may carry a predetermined sequence of material and, in order to achieve the desired dispensing, a combination of webs may be used.

In a specific example, material was weighed into cylindrical vessels about 50 mm high and having a diameter of about 25 mm. The material was weighed into each vessel using a balance. The vessels were then glued on to a web made of ESTAR TM material using glue from a 'hot glue' gun. This glue was not 'sticky' in the environment in which the material contained in the vessels was to be dispensed.

When the material stored in the vessels was needed for replenishing a process, the web was loaded on to the arrangement shown in the FIGURE. In this case, the roller was driven by a hand-crank, but naturally other drive means could be used. Collection means were provided to collect the empty vessels after their contents had been added to the process.

The dispensing arrangement was tested with vessels filled separately with calcium hydroxide, activated charcoal and water. In all cases, more that 98% of the material was dispensed into the processing vessel.

It is to be noted that the web 14 and vessels 12 can be recycled by re-filling the vessels and re-glueing them to the web.

What is claimed is:

1. A dispensing apparatus for dispensing materials stored in rigid vessels which are then attached to a continuous flexible web so as to contain the material in the closed vessel, the apparatus comprising:

drive means for driving the web through the apparatus, and removal means for removing the material from the vessels, characterized in that the removal means includes an obstruction for engaging each rigid vessel for detaching it from the web and a web direction changing means over which the web passes for releasing the material.

2. An apparatus according to claim 1 wherein the obstruction comprises a stop bar position above the at least one roller.

3. An apparatus according to claim 2, wherein the drive means comprises at least one roller over which the web moves.

4. An apparatus according to claim 1 wherein the drive means comprises at least one roller over which the web moves.

5. An apparatus according to claim 1, wherein the drive means comprises at least one roller over which the web moves and the web comprises a continuous closed loop.

* * * * *